United States Patent [19]

Clifton, Jr.

[11] Patent Number: 4,828,154

[45] Date of Patent: May 9, 1989

[54] HAND TOOL ORGANIZER

[76] Inventor: Norman E. Clifton, Jr., 9342 Indiana St., Jacksonville, Fla. 32218

[21] Appl. No.: 177,669

[22] Filed: Apr. 5, 1988

[51] Int. Cl.[4] ..... A45F 5/00

[52] U.S. Cl. ..... 224/253; 224/192; 224/222; 224/226; 224/904; 224/912

[58] Field of Search ..... 224/192, 193, 222, 226, 224/253, 267, 904, 911, 912, 247, 251, 271, 918

[56] References Cited

U.S. PATENT DOCUMENTS 4,408,706 10/1983 Hurley ..... 224/911
4,591,081 5/1986 Bianchi et al. ..... 224/911
4,677,362 6/1987 House, II et al. ..... 224/192
4,750,656 6/1988 Bianchi et al. ..... 224/911
4,759,483 7/1988 Willoughby ..... 224/253

*Primary Examiner*—Henry J. Recla
*Assistant Examiner*—Linda J. Sholl

[57] ABSTRACT

The organizer includes a molded holster for a hand tool having a piston grip, the holster having a supporting strap for suspending the holster from the waist belt of the wearer at a selected distance below the waist belt. The organizer also has a leg encircling strap to hold the holster snugly against the leg, and having optional attachments for holding a chuck key, a plurality of tool bits, a tool or nail bag, or several boxes of fasteners.

20 Claims, 4 Drawing Sheets

HAND TOOL ORGANIZER

BACKGROUND OF THE INVENTION

Workmen that require various tools in their jobs have the problem of how to carry these tools and yet have their hands free to do other things, e.g. climb a ladder. It is well known that many types of workmen have devised their own carriers that are suspended from a waist belt. A typical example is one who uses a military web belt with attachable pouches and loops that can carry screw drivers, hammers, pliers, chisels, wrenches, etc. In more recent times it has become a common practice to use hand tools that are powered by springs, electricity, compressed air, or the like, to do jobs originally done by hand, e.g. nailing, stapling, drilling, riveting, and the like. These powered hand tools are usually more bulky than their manual, unpowered predecessors, and there is a need to provide a means for carrying such tools around while leaving the hands free. One such means is a holster into which can be strapped to the body of the workman so as to be available when needed. The holsters which have appeared up to now do not have the desired adjustability so as to fit different sizes of bodies, and do not provide the most desirable facilities for carrying tool bits, keys, and the like.

It is an object of this invention to provide an improved tool organizer including a holster for a hand tool having a pistol grip handle. It is another object of this invention to provide a novel holster for a hand tool wherein the holster is adjustable in position and has optional attachments for holding tool bits, chuck key, and boxes of fasteners. Still other objects will become apparent from the more detailed description which follows.

BRIEF SUMMARY OF THE INVENTION

This invention relates to a hand tool organizer including a one-piece molded holster having an open top to receive a hand tool with a pistol grip handle. The holster has attached thereto on the portion next to the wearer an elongated strap having an upper end and a lower end and being formed of two coextensive layers fastened together by a plurality of longitudinally spaced threaded inserts through at least two of which such strap is fastened to the holster by removable fasteners, with other combinations of at least two threaded inserts providing the capability of adjusting the position of the holster along the length of the strap. The upper end of the strap extending above the holster with the two layers being releasably fastened together by a fastener to form a belt loop from which the holster is supported and readily released therefrom. The lower end of the elongated strap has a tunnel loop therein to receive an adjustable lateral strap having a releasable fastener for encircling the strap around the leg of the wearer.

In a preferred embodiment of this invention, there is a holder for tool bits fastened to the outside of the holster, the holder being a two-layer strap with a plurality of spaced rivets through both layers to provide, between rivets, places to insert and retain tool bits. In another preferred embodiment a channel clip is attached to the outside of the holster to receive and retain boxes of fasteners that might be used with a stud gun. In still another embodiment there is a strap loop releasably attached to the holster to hold a drill chuck key.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
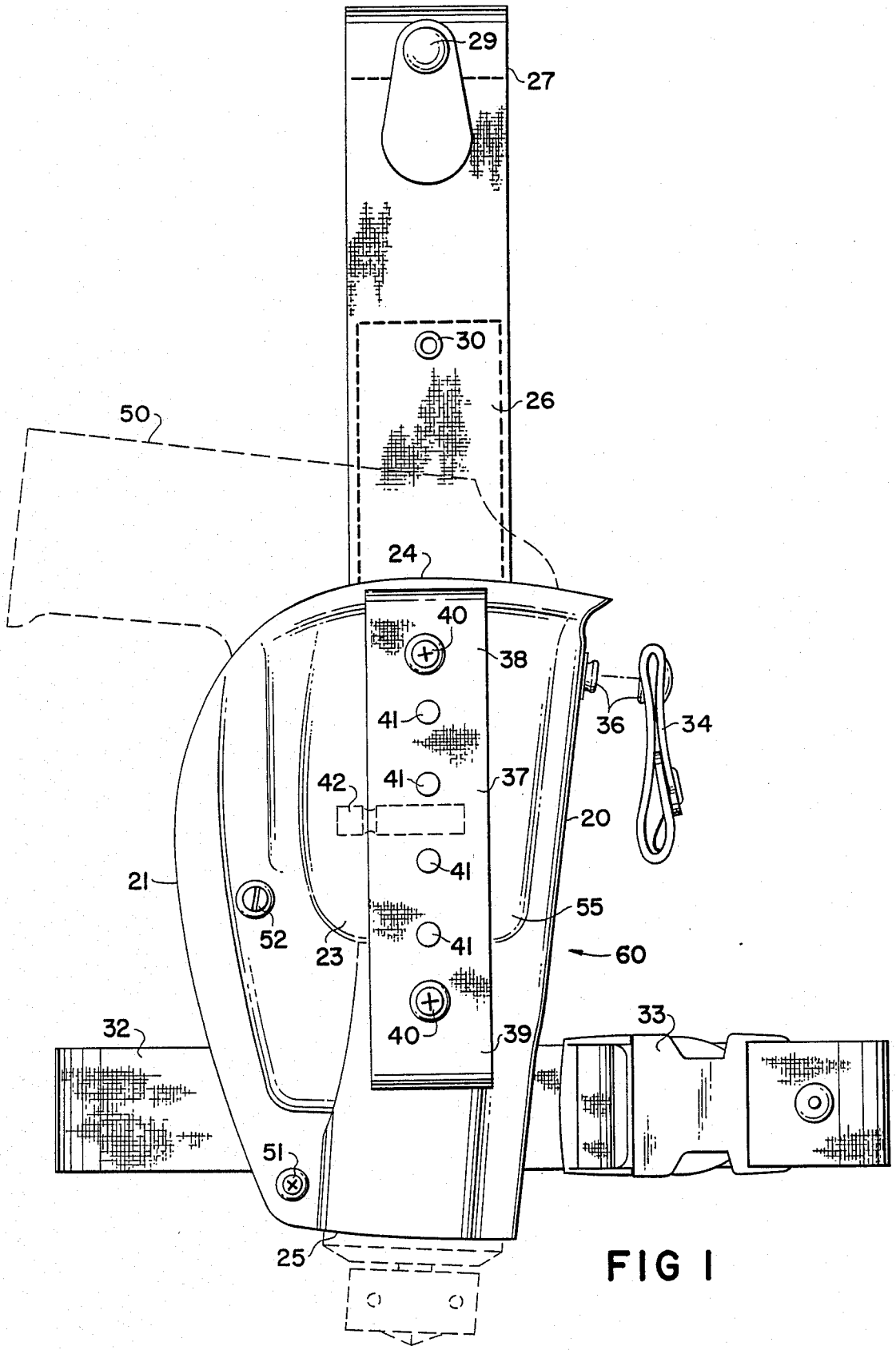
FIG. 1 is a side elevational view of one embodiment of the hand tool organizer of this invention.
Figure 2:
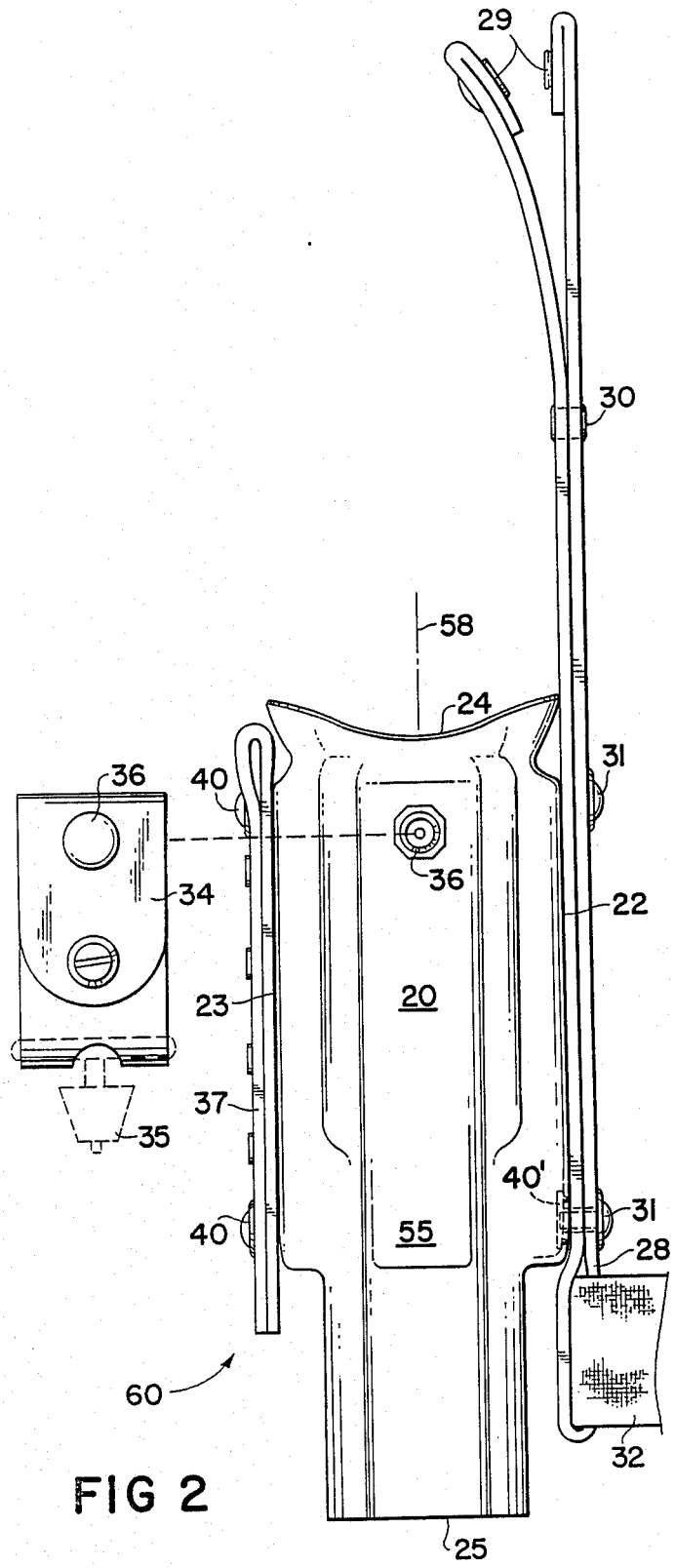
FIG. 2 is a front elevational view of the organizer of FIG. 1.
Figure 3:
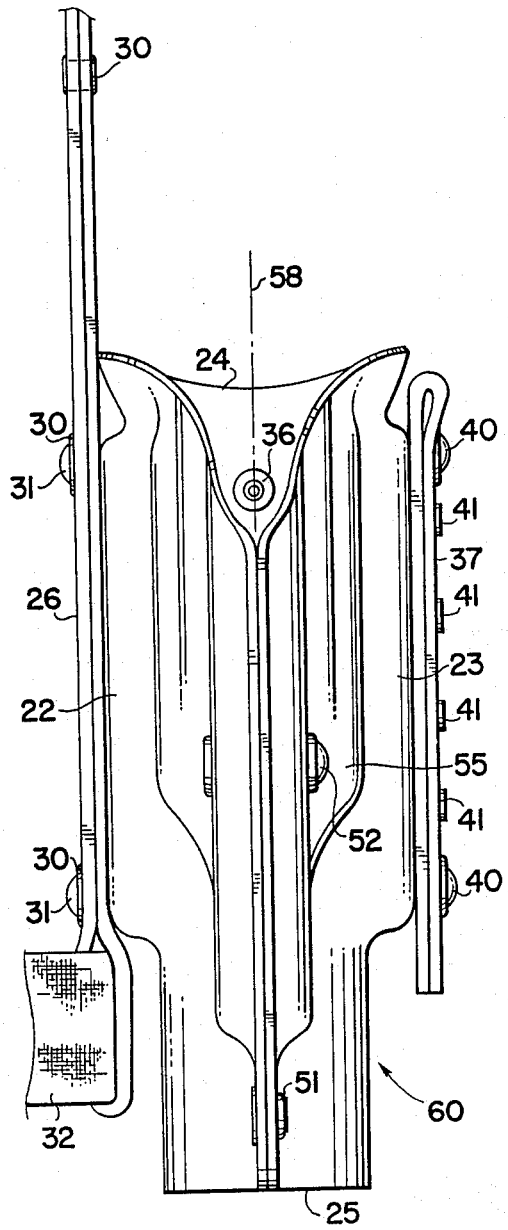
FIG. 3 is a rear elevational view of the organizer of FIG. 1.

In FIGS. 1–3 the details of this invention are readily seen. A hand tool, e.g., a power drill, 50 is enclosed in an organizer 60. The organizer 60 includes a holster 55 formed from a single piece of moldable material folded along the front portion 20 with two edges brought together at the back portion 21 and held together by a fastener 51 and a tension screw fastener 52. Holster 55 has two sidewalls 22 and 23, the former being positioned against the wearer's leg and the latter facing away from the wearer. This arrangement includes an open top 24, leading to an inside cavity into which hand tool 50 is inserted, and an open bottom 25 which permits the forward end of hand tool 50 to project downwardly. Sidewalls 22 and 23, and front portion 20 are molded to fit the outside contours of the hand tool 50.

Holster 55 is preferably made of a heat moldable thermoplastic material. Such materials are commercially available in sheet form in any of a variety of thickness. Each type of material has its own unique molding temperature, frequently known as the "softening temperature", at which level the sheet can be caused to assume any irregular shape. Generally, the preferred method of forming is to place a sheet of the thermoplastic material around an interval core of the proper contour and heat the thermoplastic to its forming temperature, press the material around the core while hot, and then cool the formed holster until it retains its formed shape. Other thermal forming methods may also be operable. Among the materials which are suitable for this purpose are polystyrene, acrylic-butadiene-styrene terpolymer, polyvinyl chloride, polyvinyl fluoride-acrylic copolymer, polyvinyl butyrate, and polycarbonate. There may be other thermoplastic sheet materials which are also suitable in this invention although the preferred types are listed above.

The thickness of the thermoplastic sheet material which is employed is not a critical limitation although it should be recognized that for larger and stronger holsters a thicker sheet material should be employed and for smaller more flexible holsters a thinner sheet material may be employed. As an overall range it may be said that the thermoplastic sheet material should have a thickness of about 0.05–0.15 inch, and for most holster applications this thickness is preferably 0.08–0.13 inch. Excellent results are obtained at a thickness of about 0.090–0.095 inch.

Holster 55 may be made solely of the moldable thermoplastic material described above, or it may be lined with a softer leather-like material to provide a more snug fit for the hand tool 50. On the other hand, holster 55 can be made to have any desired outside appearance by using any desired outside layer that will adhere to the thermoplastic material as it is being molded. The molding temperature of the thermoplastic material must be below the temperature which causes any destruction of any other layer of material being used. Generally, this temperature is about 400° F. For the most part the molding temperatures of such thermoplastic sheet materials is above about 175° F.

Figure 6:
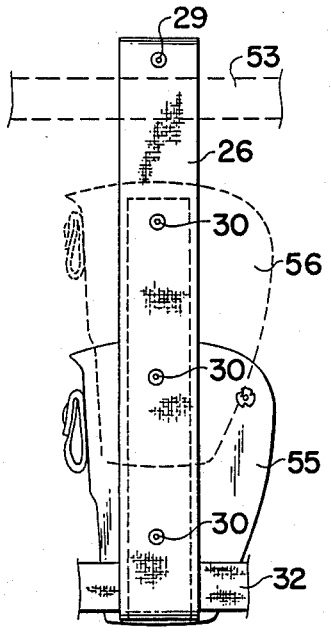
FIG. 6 is a schematic view showing the adjustability of the organizer of this invention.

Holster 55 is releasably fastened to supporting strap 26 by two fasteners 31, preferably of a screw thread type. Strap 26 is about twice as long as holster 55 from open top 24 to open bottom 25, so that holster 55 may be positioned where desired by the wearer. For this purpose there are a plurality (three shown in the drawings) of grommets 30 which are spaced apart vertically the same as the space between threaded fasteners 40. This permits holster 55 to be positioned higher or lower on strap 26, as more specifically shown in FIG. 6, indicating positions 55 and 56 when selecting different combinations of grommets 30. Externally threaded fasteners 40 mate with internally threaded fasteners 40', one being shown in broken lines in FIG. 2, which may be in the form of a common T-nut with spaced prongs which embed in the side walls 22 and 23 to inhibit rotation thereof.

Supporting strap 26 is preferably made of two coextensive layers of strap material, which may be a woven textile, leather, or a plastic strap. At upper end 27 the two layers are separable as shown in FIG. 2 and have a snap fastener 29 at the extreme upper end to selectively fasten or unfasten those two layers. Preferably, fastener 29 is a directional snap fastener that opens and closes only when the two component parts are positioned in an indexed orientation with respect to each other. This arrangement permits an easy attachment to the waist belt of the wearer, without the awkward necessity of unfastening the waist belt and risking the wearer's pants dropping from the waist.

At lower end 28 of supporting strap 26 a tunnel loop is provided by an open space between the two layers of material in strap 26. This tunnel loop is adapted to receive a lateral strap 32 therethrough which is adjustable in length and includes a suitable buckle 33. Strap 32 and its buckle 33 are intended to provide a leg encircling band which holds bottom end 25 of holster 55 snugly against the leg of the wearer to prevent swinging or flapping of the holster during wearer movement, helping to insure that hand tool 50 will not inadvertently fall out of holster 55, and also, to make it easier to withdraw hand tool 50 from a tight fitting holster 55.

An optional feature of this invention is holder 34 which releasably snaps, by way of fastener 36, which also preferably is a directional fastener as described above, to front 20 of holster 55. Holder 34 is intended to retain a chuck key 35 for a power drill hand tool 50. Holder 34 and key 35 may be unsnapped from holster 55, used to attach or detach a drill bit from power drill 50, and then snapped back in place on holster 55. Any other type of small tool, key, wrench, or the like, may be fastened to holster 55 in a similar manner.

Another optional feature of this invention is a tool bit holding strap 37 fastened to the outside side wall 23 of holster 55 by releasable fasteners 40. Strap 37, in a preferred embodiment, is formed of two coextensive layers of material held together by spaced rivets 41 and by grommets 40 through which releasable externally threaded fasteners 40 extend. In between adjacent rivets 41, the two layers are sufficiently flexible to insert a tool bit 42 or other similar items. If the two layers of strap 37 have sufficiently rough surfaces, or are elastic or the like, tool bit 42 will be held by frictional forces and will not fall out inadvertently. A textile webbing is a suitable material for the layers of strap 37, although leather, rubber, and plastic straps are also operable.

Figure 4:
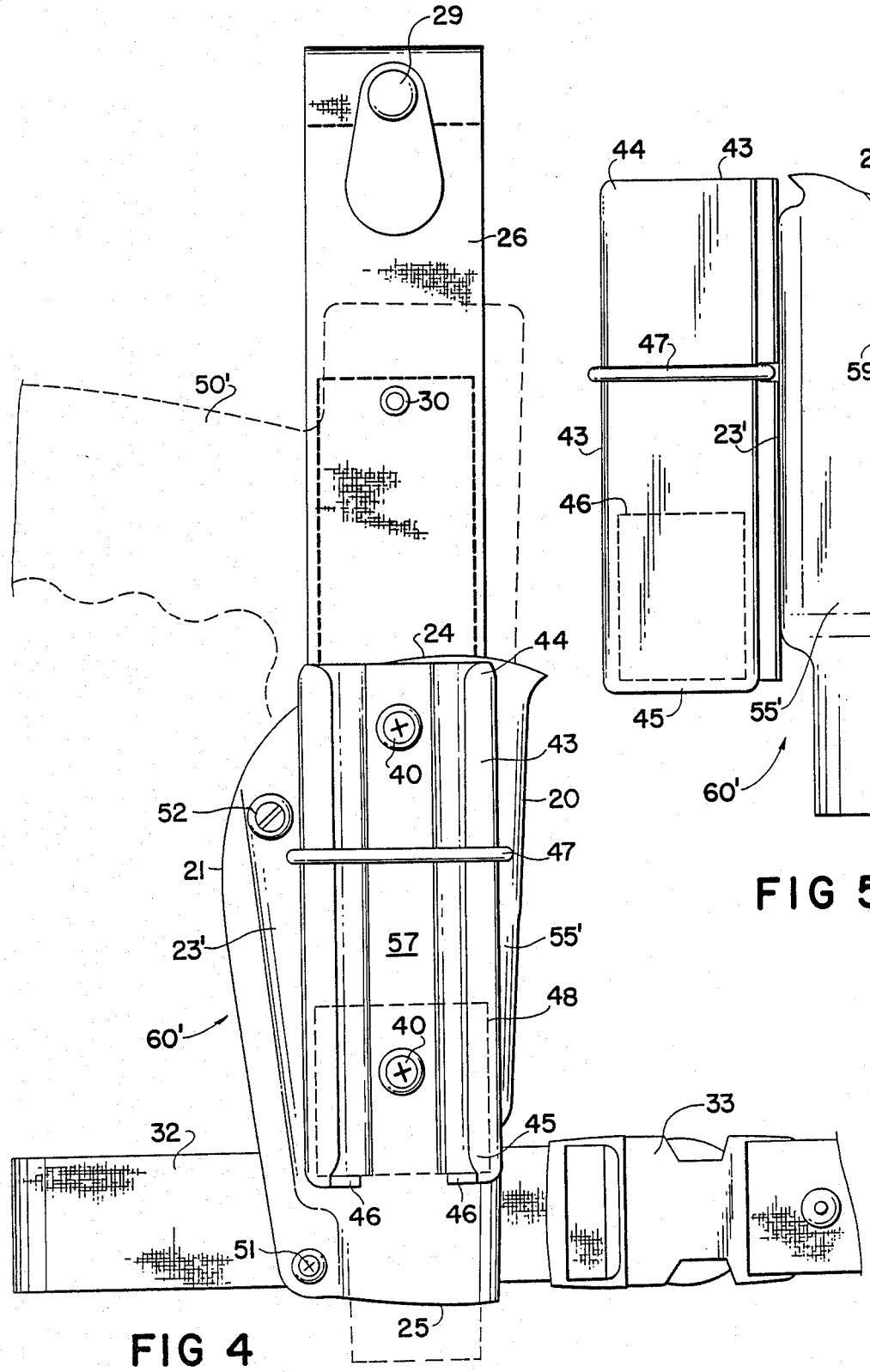
FIG. 4 is a side elevational view of a second embodiment of the hand tool organizer of this invention.
Figure 5:
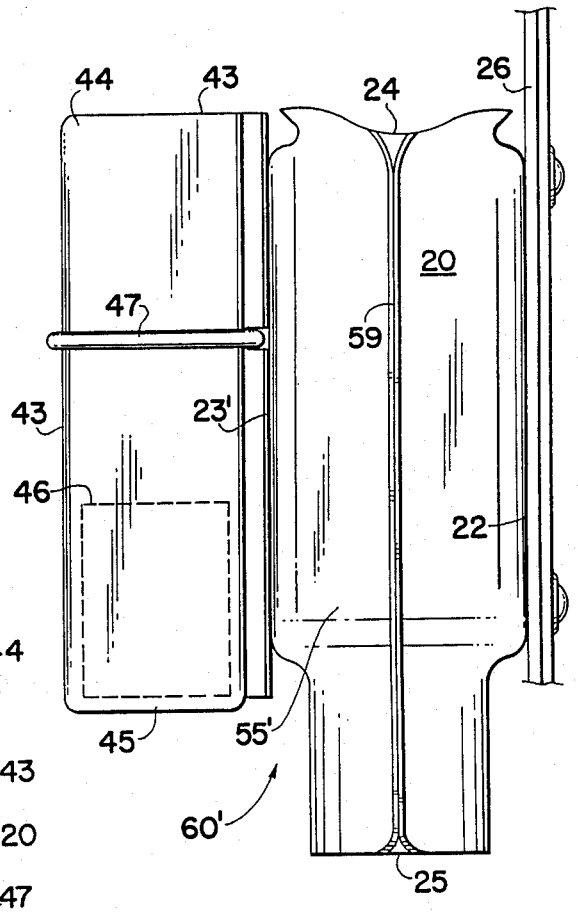
FIG. 5 is a front elevational view of the organizer of FIG. 4.

Still another optional feature is shown in FIGS. 4 and 5 where the organizer 60' is for a stud gun 50' hand tool. Holster 55' is molded to the shape of stud gun 50', and it has all the previously described features of a supporting strap 26 on which holster 55' is vertically adjustable and a leg encircling strap 32. In this instance there is no provision for a loop holder 34 retaining a chuck key 35, because a stud gun requires no such key. For stud gun 50' there is a need to keep a supply of power loads that can be loaded into stud gun 50' for use when desired. For this purpose there is a channel clip means 43 attached to the outside side wall 23' of holster 55' by releasable fasteners 40 of the same type and location as described above with respect to FIGS. 1–3. Channel clip means 43 is a generally rectangular chute closed on three sides and having an open front slotted portion 57 to permit the wearer's fingers to have ready access to contact a box 48 of power loads to remove same. Channel clip means 43 has an open top end 44 and a bottom end 45 with inturned stop flanges 46 to prevent boxes 48 from sliding out the bottom of channel clip means 43. Generally, channel clip means 43 is about as long as holster 55 so as to provide as much storage capacity for boxes 48 of power loads, which may be needed in different sizes for different jobs. It may be desired to include an elastic band 47 around the outside of channel clip means 43 to squeeze together the portions of the channel bordering on open position 57. Such a squeezing is only needed if the channel clip means does not provide enough frictional forces to keep boxes 48 from inadvertently falling out of the channel.

Figure 7:
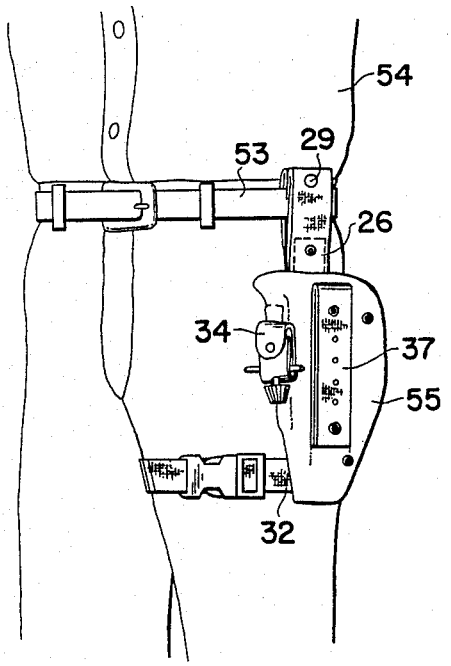
FIG. 7 is a schematic view showing the organizer of this invention worn on the left side of the wearer.
Figure 8:
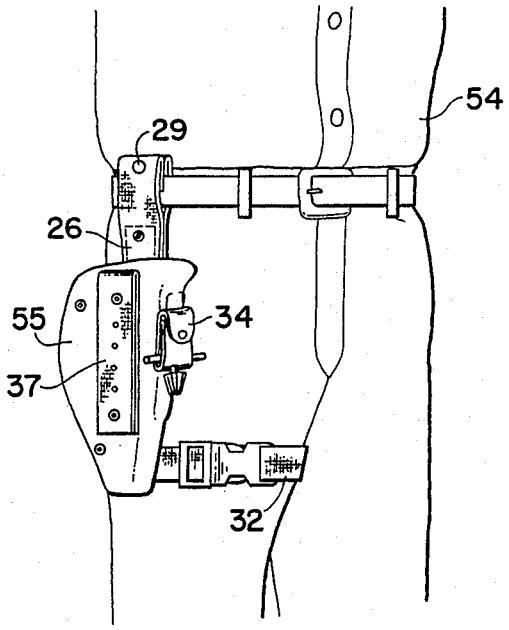
FIG. 8 is a schematic view showing the organizer of this invention worn on the right side of the wearer.

Another feature of holster 55 (or 55') is its reversibility. In FIGS. 7 and 8 the same holster 55 and its accompanying features supporting strap 26, leg strap 32, key holder 34 and tool bit holder 37 can be worn on the right leg or the left leg as desired. Holster 55 is molded and punched holes and T-nuts 40' are located to make it symmetrical about central plane 58 as shown in FIGS. 2 and 3. Plane 58 is vertical and passes through the vertical centerline of front portion 20 and back portion 21 of holster 55. Holes to match grommets 30, T-nuts 40' and fasteners 40 are identically located and spaced on side walls 22 and 23 so that supporting strap 26 and tool bit strap 37, and channel clip means 43 may be attached to either side of holster 55.

In some instances, e.g., where the hand tool 50 is extraordinarily long, it may be desirable to employ a front opening holster which permits the hand tool 50 to be pushed forward causing side walls 22 and 23 to spread apart along juncture 59 (as shown in dotted lines in FIG. 5) where the forward edges of side walls 22 and 23 join and are held in place by the bias of fastener 51 and tension screw 52. If hand tool 50 is sufficiently short to be withdrawn from holster 55 upwardly through open top 24, it may be preferred not to employ this front opening embodiment, but rather to have a nonopening front wall 20 as shown in solid lines in FIG. 5.

A molded thermoplastic tool bag or a leather or textile (e.g., canvas) tool bag may also be attached to holster 55 at and by fasteners 40, in addition to or in place of tool bit holder 37 or channel clip 43. This is merely to illustrate that any type of container or assistant may be attached via fasteners 40 and still be within the spirit of this invention.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a hand-tool organizer comprising a one-piece molded holster, having an open top to receive a hand tool with a pistol grip handle, an elongated strap attached to said holster on the portion next to a wearer, said elongated strap having an upper- end and a lower end and being formed of two coextensive layers fastened by a pair of longitudinally spaced internally threaded inserts affixed to said portion of said holster aligned with at least two spaced grommets affixed to said strap which is fastened to said holster by a pair of removable externally threaded fasteners passing through respective said grommets and threaded within respective said inserts, said strap having at least one additional spaced grommet identically spaced from either said two spaced grommets whereby said one additional grommet and one of said two grommets may be selected for attachment to said holster so that the position of said holster may be adjusted along the length of said strap, said upper end of said strap extending above said holster with said two layers being releasably fastened together by a fastener to form a belt loop from which said holster is supported, said lower end of said elongated strap having a tunnel loop therein to receive an adjustable lateral strap having a releasable fastener for encircling said lateral strap around a leg of a wearer.

2. The organizer of claim 1 further comprising loop means for holding a drill chuck key, said loop means being releasably fastened to the outside of said holster.

3. The organizer of claim 2 further comprising a releasable snap fastener connected between said loop means and said holster.

4. The organizer of claim 1 further comprising an elongated portion formed of two coextensive straps releasably fastened at both ends thereof to an outside portion opposite to said portion.

5. The organizer of claim 1 further comprising a channel clip means releasably attached to an outside portion of said holster opposite to said portion next to a wearer, said channel clip means being adapted to receive slidably therein boxes of fastening devices to be employed by said hand tool, said channel clip means being oriented to receive said boxes at an upper end thereof and to retain said boxes therein from lateral displacement, said channel clip means having at least one shoulder adjacent its bottom end to prevent passage of said boxes out of said channel bottom end.

6. The organizer of claim 5 further comprising an elastic band laterally disposed around said channel clip means and adapted to squeeze said channel clip means against boxes carried therein.

7. In a hand-tool organizer comprising a one-piece thermoplastic sheet molded holster, having an open top to receive a hand tool with a pistol grip handle, an elongated strap attached to said holster on a portion of said holster next to a wearer, said elongated strap having an upper end and a lower end, a pair of longitudinally spaced internally threaded inserts affixed t said portion of said holster said strap having a plurality of spaced openings with the spacing between adjacent openings conforming to the spacing between said threaded inserts, a pair of removable externally threaded fasteners passing through selected spaced openings and threaded within respective said inserts so that the position of said holster may be adjusted along the length of said strap, said upper end of said strap extending above said holster, said strap at its upper end being bifurcated so as to form a belt loop, releasable fastener means connected at said upper end to permit ready attachment of said strap to a belt of a wearer from which said holster is supported.

8. The organizer of claim 7 wherein said lower end of said elongated strap having a tunnel loop therein, an adjustable lateral strap passing through said tunnel loop and having a releasable fastener for encircling said lateral strap around a leg of a wearer.

9. The organizer of claim 7 wherein another pair of spaced internally threaded inserts are affixed to an opposite portion of said holster disposed laterally across and in respective alignment with said pair of internally threaded inserts affixed to said portion of said holster, said strap being disconnectable from said pair of inserts and connectable to said other pair of inserts by said pair of externally threaded fasteners whereby said organizer may be worn on a left or right side of a wearer.

10. The organizer of claim 9 further comprising means connectable to at least one said internally threaded inserts opposite to said strap for providing an accessory holder for use with a hand tool carried by said holder.

11. In a tool organizer comprising a molded holster for a hand tool with a pistol grip handle and adapted to be suspended from a wearer's waist belt, said holster having with respect to a wearer, a front, back, an open top, an open bottom, an inside wall adjacent to a wearer, and an outside wall facing away from a wearer, an elongated vertical strap of two layers and having an upper end extending above said open bottom, a plurality of grommets spaced apart vertically along said strap intermediate of said ends, a pair of spaced internally threaded inserts being fastened to said holster inside wall, a pair of releasable fasteners applied through two of said grommets and threaded respectively into said threaded inserts, said holster being attachable at different locations along said strap by said releasable fasteners extending through another pair of said grommets one of which being one of said two grommets, releasable means at said upper end for separating said two layers to selectively fasten said two layers together to form a tunnel loop for engagement with a waist belt, and a tunnel loop at said lower end of said strap to receive therethrough a lateral adjustable length belt having a releasable fastener thereon to form a leg encircling belt.

12. The organizer of claim 11 further including a strap loop releasably fastened to the outside of said holster, said strap loop being adapted to receive and retain in said loop a chuck key for a hand tool.

13. The organizer of claim 11 further comprising tool bit holding strap attached to said outside wall, said strap being formed of two layers of material releasably fastened at each end thereof to said outside wall, said two layers of said strap portion intermediate said two ends thereof being held together by a plurality of rivets spaced apart longitudinally of said strap with a space between adjacent rivets of a sufficient distance to permit a tool bit to be retained therein when pushed laterally into said space between said two layers.

14. The organizer of claim 11 further comprising an elongated channel clip having a bottom and vertical sides, said bottom being releasably fastened to said outside wall with the longitudinal axis of said channel being substantially vertical, said channel having an open end adjacent said open top of said holster and being adapted to slidably receive therein boxes of fastening devices used by a hand tool, said channel having a lower end adjacent said open bottom of said holster, and stop means connected to said lower end to retain said boxes in said channel clip and prevent removal of said boxes out through said lower end.

15. The organizer of claim 14 further comprising an elastic band laterally encircling said channel clip means to squeeze said vertical sides of said channel clip against boxes carried internally therein.

16. In a tool organizer comprising a holster for a hand tool with a pistol grip handle and adapted to be suspended from a wearer's waist belt, said holster being formed from a heat moldable thermoplastic sheet material having an inside cavity conforming generally to an outer contour of a hand tool to be carried by said holster, said holster having with respect to a wearer a front, back, an open top, an open bottom, an inside wall adjacent to a wearer, and an outside wall facing away from a wearer, an elongated vertical strap of two layers and having an upper end extending above said open bottom, a plurality of openings spaced apart vertically along said strap intermediate of said ends, a pair of spaced internally threaded inserts being fastened to said holster inside wall, a pair of releasable fasteners applied through two of said openings and threaded respectively into said threaded inserts, said holster being attachable at different locations along said strap by said releasable fasteners extending through another pair of said openings one of which being one of said two openings, releasable means at said upper end for separating said two layers to selectively fasten said two layers together to form a tunnel loop for engagement with a waist belt.

17. The organizer of claim 16 wherein said strap includes a tunnel loop at said lower end of said strap, said organizer further comprising a lateral adjustable length belt passing through said tunnel loop at said lower end of said strap and having a releasable fastener thereon to form a leg encircling belt.

18. The organizer of claim 16 wherein said internally threaded inserts are located partially within said cavity and disposed to avoid engagement with a hand tool to be carried by said holster.

19. The organizer of claim 16 wherein another pair of spaced internally threaded inserts are fastened to said holster outside wall and are laterally aligned respectively with said pair of spaced internally threaded inserts whereby said strap may be connected thereto by said pair of releasable fasteners so that said organizer may be worn on a left or right side of a wearer.

20. The organizer of claim 19 further comprising means on a wall of said holster opposite to a wall to which said elongated strap is connected for providing an accessory holder for use with a hand tool carried by said holster.

* * * * *